United States Patent [19]

Kanbier et al.

[11] 4,073,721

[45] Feb. 14, 1978

[54] CATALYST REGENERATION BY CIRCULATING CATALYST IN A HYDROTREATING OIL PROCESS

[75] Inventors: Dirk Kanbier, The Hague; Frans Goudriaan, Amsterdam, both of Netherlands

[73] Assignee: Shell Oil Company, Houston, Tex.

[21] Appl. No.: 809,256

[22] Filed: June 23, 1977

[30] Foreign Application Priority Data

July 6, 1976 United Kingdom ..... 28067/76

[51] Int. Cl.[2] ..... C10G 23/08

[52] U.S. Cl. ..... 208/251 H; 208/78; 208/213; 208/216; 252/414

[58] Field of Search ..... 208/213, 216, 111, 78, 208/210, 251 H

[56] References Cited

U.S. PATENT DOCUMENTS

| | | | |
|---|---|---|---|
| 3,133,013 | 5/1964 | Watkins | 208/216 |
| 3,161,586 | 12/1964 | Watkins | 208/210 |
| 3,679,574 | 7/1972 | Irvine | 208/251 H |
| 3,795,607 | 3/1974 | Adams et al. | 208/210 |
| 3,809,644 | 5/1974 | Johnson et al. | 208/78 |
| 4,016,069 | 4/1977 | Christman et al. | 208/210 |
| 4,016,070 | 4/1977 | Christman et al. | 208/210 |

*Primary Examiner*—George Crasanakis
*Attorney, Agent, or Firm*—Ronald R. Reper

[57] ABSTRACT

A process is disclosed for catalytic hydrotreating of a heavy hydrocarbon oil and a light hydrocarbon oil in separate reactors, wherein the hydrotreating catalyst is circulated through both reactors. The process is particularly suited to obtaining long catalyst life when operating at low hydrogen pressures.

6 Claims, 1 Drawing Figure

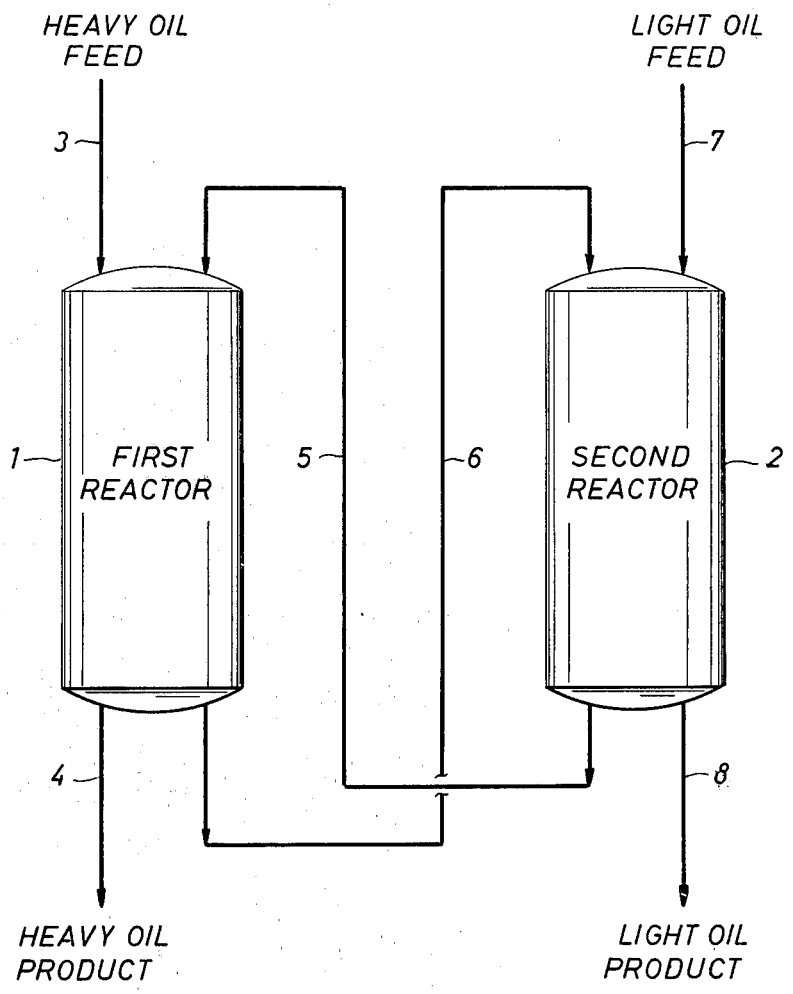
HEAVY OIL FEED
LIGHT OIL FEED
3
7
1
FIRST REACTOR
5
6
SECOND REACTOR
2
4
8
HEAVY OIL PRODUCT
LIGHT OIL PRODUCT

CATALYST REGENERATION BY CIRCULATING CATALYST IN A HYDROTREATING OIL PROCESS

BACKGROUND OF THE INVENTION

The invention relates to a process for hydrotreating a heavy oil and a light oil by alternately contacting the heavy oil and the light oil in the presence of hydrogen with a catalyst which has hydrogenating properties.

The hydrotreating processes for heavy oils include hydrodesulphurization, hydrodemetallization, hydrocracking and the like. The hydrotreating is generally carried out at elevated temperatures and hydrogen pressures with a catalyst which has hydrogenating properties. Typically the activity of the catalyst declines during the process due to the deposition of coke onto the surface of the catalyst. When the activity of the catalyst has reached an intolerable low level, the catalyst may be regenerated by burning off the coke, e.g., with the aid of an oxygen-containing gas. However, such a regeneration is disruptive of operations and is time-consuming; accordingly, the frequency of regeneration should be reduced as much as possible or it should be avoided all together. The rate of deposition of coke, and accordingly the rate of deactivation of the catalyst, can be reduced by using high hydrogen pressures, e.g., hydrogen partial pressures of 100 kg/cm$^2$ and higher. However, for many applications the use of the high pressures is unattractive in view of the attendant necessity to employ costly high pressure-resistant apparatus.

It is possible to regenerate a catalyst which is at least partly deactivated after being contacted with a heavy oil by contacting the deactivated catalyst with a light oil in the presence of hydrogen at conditions similar to those used during the hydrotreatment of the heavy oil. During the hydrotreatment of the light oil at least part of the coke deposited on the catalyst is removed. So, it is possible to regenerate a catalyst by replacing the heavy oil feed to the reactor by a light oil feed. After the coke has been removed from the catalyst to a sufficient extent, the light oil feed is replaced again by the heavy oil feed. Such a procedure may be used at relatively low hydrogen pressures. However, a drawback is that contamination of the heavy oil with the light oil will occur, typically requiring additional separation operations.

The invention provides a process which overcomes this drawback by hydrotreating the heavy oil and the light oil in separate reactors.

SUMMARY OF THE INVENTION

Accordingly, the invention provides a process for hydrotreating a heavy oil and a light oil by alternately contacting the heavy oil and the light oil in the presence of hydrogen with a catalyst which has hydrogenating properties, in which process the heavy oil and the light oil are contacted with the said catalyst in separate reactors and the catalyst is circulated through both reactors.

BRIEF DESCRIPTION OF THE DRAWING

The FIGURE schematically represents an embodiment of the hydrotreating process of the invention wherein a heavy oil and a light oil are each fed to separate reaction zones and a hydrotreating catalyst is circulated through both zones.

DESCRIPTION OF THE PREFERRED EMBODIMENTS

The oils to be used in the process of this invention will in general be a mixture consisting substantially of hydrocarbons; in most cases they will be mineral oil-based derived from petroleum.

In the context of this invention the expressions "heavy oil" and "light Oil" are interrelated; the difference between a heavy oil and a light oil which are both to be contacted with a given catalyst is defined in that the heavy oil has a Conradson Carbon residue percentage (CCT) according to ASTM D 189 at least twice that of the light oil and that at least part of the hydrocarbons of a heavy oil will have a boiling point at atmospheric pressure higher than 371° C. A light oil will in general consist of a mixture of hydrocarbons, which mixture is substantially free of components with a boiling point at atmospheric pressure higher than 371° C. Exemplary heavy oils include crude mineral oils and products derived therefrom, such as topped crude mineral oils, long residues, short residues, flashed distillates, vacuum distillates, deasphalted oils and asphalts. Other examples of heavy oils are heavy fractions obtained by pyrolysis of coal, bituminous shale or tar sand.

Exemplary light oils may be mentioned kerosines, gas oils, oils emerging from catalytic cracking processes (so-called cat. cracked cycle oils).

The light oil to be used according to the invention very suitably has a high content of aromatic compounds; very suitable are cat. cracked cycle oils. It is an additional advantage of the present invention that the quality of the light oil is improved as a result of the process according to the invention, and the products obtained may very suitably be used as fuel, e.g., as diesel fuel or as fuel for heating systems.

The catalyst with hydrogenating properties to be used will be dependent on the type of hydrotreatment to be performed. In many cases the catalyst will be a supported catalyst and the hydrogenating properties will be provided by metals or metal compounds present on the support.

Refractory materials, such as alumina, silica and silica-alumina, are very suitable as supports. Very suitable metals with hydrogenating activity are metals of Groups VI and VIII of the Periodic Table of Elements, such as molybdenum, tungsten, cobalt and nickel. Preference is given to catalysts containing at least one metal of Group VI and at least one metal of Group VIII, e.g., catalysts containing cobalt and/or nickel together with molybdenum and/or tungsten. The metals may be present as such, in the form of compounds, such as oxides, sulphides or other salts. If desired, other elements, such as halogens, e.g. fluorine or chlorine may be present in the catalyst.

it will be clear that the description given of very suitable components of the catalyst is not limitative; in any specific case the composition of the catalyst will be dependent on the hydrotreating reaction to be carried out.

The temperatures in the reactors may vary between wide limits; they need not be the same in both reactors. The temperatures employed will in general lie between 200° and 600° C, and preferably between 300 and 450° C.

The pressure to be applied may vary between wide limits, and may even be as high as 200 kg/cm$^2$. However, one of the specific advantages of the present invention is to be found in the applicability of relatively low hydrogen pressures. Hydrogen pressures from about 20 kg/cm² to about 100 kg/cm², and particularly between 20 and 50 kg/cm² are preferred.

Pure hydrogen may be used, but this is not necessary. A gas with a hydrogen content of 70% or more by volume is very suitable. A hydrogen-containing gas originating from a catalytic reforming plant may be used with advantage.

The weight hourly space velocity may vary between wide limits, and may be different in each of the two reactors. Weight hourly space velocities will suitably be in the range from about 0.1 to about 10, and preferably from about 0.2 to about 8.

Although ebullated catalyst beds, in which the oil passes in upflow through the reactors, may be used, it is preferred to use a fixed bed of catalyst or a moving fixed bed of catalyst and pass the oil in downflow through the reactor.

In case fixed beds of catalysts are used the heavy oil is passed in the first reactor over the catalyst together with hydrogen until the hydrogenating activity of the catalyst has dropped to an unacceptable level. Subsequently, the catalyst is removed from the first reactor and introduced into the second reactor. The catalyst present in the last-mentioned reactor has been removed therefrom before the introduction of the catalyst emerging from the first reactor and the catalyst emerging from the second reactor is introduced into the first reactor.

The process according to the invention is particularly suitable to be applied in a system of two reactors, each of which contains a so-called moving fixed bed of catalyst, which means that the catalyst in the form of a substantially fixed bed is moving slowly through the reactors by continuous or periodic addition of catalyst at the top and continuous or periodic removal of catalyst at the bottom of the reactors.

The expression "substantially fixed bed" denotes a catalyst bed which during the process may contract or swell less than 10%, depending on whether the operation is carried out in downflow (which is preferred) or in upflow of the feed respectively. This 10% contracting or swelling of the catalyst bed relates to the volume of the catalyst bed during operation as compared with the volume which the loosely packed catalyst in oil occupies when no oil moves through the bed. Such a moving fixed bed process is described in the British patent specification No. 1,331,935.

The transport of the catalyst from one reactor to the other may be carried out in any desired manner; pumping of a slurry of the catalyst in an oil is very suitable. If desired, the catalyst may be freed from entrained oil by washing with a suitable oil, which may be the feed of the reactor in which the catalyst is to be introduced.

The invention is illustrated by the FIGURE which depicts in a schematic form an embodiment of the invention. Heavy oil is introduced via line 3 into the first reactor 1, and hydrotreated heavy oil leaves this reactor via line 4. Regenerated catalyst is introduced into reactor 1 periodically via line 5. Deactivated catalyst leaves reactor 1 periodically and is transported to the second reactor 2 via line 6. Light oil is fed to reactor 2 via line 7 and hydrotreated light oil is removed from reactor 2 via line 8. The regenerated catalyst is periodically removed from reactor 2 and transported to reactor 1 via line 5.

EXAMPLE

For the desulphurization of a long residue of a Middle East crude two reactors were used as depicted in the FIGURE. Both were loaded with a catalyst with a bulk density of 0.67 kg/l comprising 4 p.b.w. of nickel and 11 p.b.w. of molybdenum on 100 p.b.w. of alumina as a support. Both reactors contained a moving fixed bed of catalyst and the catalyst flow from and to each reactor via lines 5 and 6 amounted to 0.45 ton/hr. The conditions applied in each reactor are given in table I.

Via line 3 the long residue of a Middle East crude to be desulphurized was introduced into reactor 1 at a rate of 100 ton/hour. The properties of this oil are depicted in table I column A. The desulphurized oil was removed from the first reactor via line 4, and the properties of this oil can be found in Table II column B.

The light oil fed to reactor 2 via line 7 at a rate of 50 ton/hr. consisted of a mixture of a flashed distillate of a Middle East crude and a butane-deasphalted oil. The treated oil was removed via line 8. The properties of the feed to, and the product of reactor 2 are depicted in Table III columns A and B respectively.

Hydrogen leaving the reactors together with the liquid product was recycled and fresh hydrogen was added to replaced hydrogen consumed in the reaction.

The system ran smoothly, no unacceptable deactivation of the catalyst due to coking occurred. Because of the activity for vanadium removal of the catalyst decreases with increasing deposition of vanadium on the catalyst, fresh catalyst was added periodically and spend catalyst was periodically removed.

Table I

| | Reactor 1 | Reactor 2 |
|---|---|---|
| Temperature ° C | 375 | 375 |
| WHSV of feed (Kg/1/hr) | 0.5 | 1.0 |
| $P_{H2}$ (bar) | 35 | 35 |
| Reactor volume (m³) | 200 | 50 |

Table II

| Reactor 1 | A. Feed | B. Product |
|---|---|---|
| Sulphur % w | 3.85 | 1 |
| Viscosity cSt at 210° F | 30.2 | 20 |
| Vanadium content p.p.m.w. | 46 | 25 |
| Density $^{70}_{4}$ g/ml | 0.92 | 0.85 |
| Conradson Carbon, ASTM D 189, % | 10.0 | — |

Table III

| Reactor 2 | A. Feed | B. Product |
|---|---|---|
| Sulphur % w | 3.36 | 0.45 |
| Viscosity cSt at 210° F | 19.9 | 10.2 |
| Vanadium content p.p.m.w. | 2 | 0.2 |
| Nickel content p.p.m.w. | 0.5 | 0.1 |
| Density $^{70}_{4}$ g/ml | 0.91 | 0.89 |
| Conradson Carbon, ASTM D 189, % | 2.5 | — |

What is claimed is:

1. A process for hydrotreating (1) a light mineral hydrocarbon oil feed having an atmospheric final boiling point less than 371° C and a measurable Conradson Carbon residue, and (2) a heavy mineral hydrocarbon oil feed at least part of which has an atmospheric boiling point above 371° C, and having a Conradson Carbon residue at least twice that of said light oil feed, which process comprises:

(a) contacting said heavy oil in a first reactor and said light oil in a second reactor at an elevated temperature and pressure with hydrogen and with a hydrotreating catalyst (b) separating a heavy oil product of lower metal content than said heavy oil feed from said first reactor and a light oil product from said second reactor, and (c) circulating regenerated catalyst from the bottom of said second reactor to the top of said first reactor and at least partly deactivated catalyst from the bottom of said first reactor to the top of said second reactor.

2. A process as in claim 1 wherein the catalyst comprises at least one Group VI metal and at least one Group VIII metal on a support selected from alumina, silica and silica alumina.

3. A process as in claim 2 wherein the catalyst contains at least one metal selected from cobalt and nickel and at least one metal selected from molybdenum and tungsten.

4. A process as in claim 1 wherein during said contacting step (a) in said first reactor and said second reactor the temperature is in the range from about 200° to about 600° C; the hydrogen partial pressure is in the range from about 20 to about 200 kg/cm$^2$ and the weight hourly space velocity is in the range from about 0.1 to about 10.

5. A process as in claim 4 wherein in during said contacting step (a) in said first reactor and said second reactor the temperature is in the range from about 300° to about 450° C, the hydrogen partial pressure is in the range from about 20 to 100 kg/cm$^2$, and the weight hourly space velocity is in the range from about 0.2 to about 8.

6. A process as in claim 1 wherein said catalyst in step (c) is circulated as a slurry in a mineral oil.

* * * * *